US006004455A

United States Patent [19]

Rendall

[11] Patent Number: 6,004,455

[45] Date of Patent: Dec. 21, 1999

[54] SOLVENT-FREE METHOD AND APPARATUS FOR REMOVING BITUMINOUS OIL FROM OIL SANDS

[76] Inventor: John S. Rendall, 4301 Altura NE., Albuquerque, N.Mex. 87110

[21] Appl. No.: 08/943,874

[22] Filed: Oct. 8, 1997

[51] Int. Cl.[6] ..... C10G 1/04

[52] U.S. Cl. ..... 208/390; 208/426; 208/432; 208/177; 196/14.52

[58] Field of Search ..... 208/391, 390, 208/426, 177; 196/14.52

[56] References Cited

U.S. PATENT DOCUMENTS

| | | | |
|---|---|---|---|
| 4,424,112 | 1/1984 | Rendall | 208/11 |
| 4,875,998 | 10/1989 | Rendall | 208/390 |
| 5,124,008 | 6/1992 | Rendall et al. | 204/61 |
| 5,762,780 | 6/1998 | Redall et al. | 208/391 |
| 5,795,444 | 8/1998 | Redall et al. | 208/390 |

OTHER PUBLICATIONS

Canadian Patent Application 2,205,208, laid open Jul. 16, 1997 by Steven J. Lane entitled Oilsands Separation.

Canadian Patent Application 2,165,252, laid open Jul. 16, 1996, by John S. Rendall and Steven J. Lane.

*Primary Examiner*—Helane Myers

*Attorney, Agent, or Firm*—Thomas E. Schatzel; Law Offices of Thomas E. Schatzel, A Prof. Corp.

[57] ABSTRACT

A sand/liquid separator provides for the conditioning of oil sands. Clean sand is separated from the ore and discharged for use as backfill. The sand/liquid separator machine includes horizontal shafts with paddles that act on a fluidized bed. The overall height of the machine is increased over prior art devices so the water volume is expanded. For a given residence time, more sand can be separated out than is otherwise possible. The water-to-sand ratio is an independent variable, water is recycled independent of the sand. The rate of water recycle depends only on the heat input needed and the clay content of the feed. The rate of water input is limited by the rise velocity needed to separate sand larger than forty-four micron from the water/liquid phase. This, in turn, determines the maximum oil sand feed rate based on the total clay in the feed at up to six percent, by weight, of clay in the middlings in the machine. This optimizes the performance of the process to cope with all the variables of heat input, ratio of oil sand feed to water, and clay content of the feed.

8 Claims, 3 Drawing Sheets

SOLVENT-FREE METHOD AND APPARATUS FOR REMOVING BITUMINOUS OIL FROM OIL SANDS

RELATED PATENTS

The present inventor, John S. Rendall, is an inventor named in three related U.S. Pat. Nos.: 4,424,112, issued Jan. 3, 1984; 4,875,998, issued Oct. 24, 1989; and 5,124,008, issued Jun. 23, 1992, and U.S. patent application, Ser. No. 08/356,148, filed Dec. 15, 1994. The present inventor is further an inventor named in a related Canadian Patent Application, 2,165,252, laid open Jun. 16, 1996. All such patents further including U.S. Pat. No. 5,480,566, issued to Strand on Jan. 2, 1996 and are incorporated herein by reference as if set out in full.

BACKGROUND OF THE INVENTION

1. Field of the Invention

The invention relates generally to mining and specifically to the removal of bitumen from rocks, sands and clay.

2. Description of the Prior Art

Vast deposits of oil exist throughout the world, and especially in Canada, as thick, heavy oil, in the form of bitumen mixed with solid minerals and water. The tar sands that hold the bitumen contain rich amounts of valuable minerals, especially alumina, in the sand itself. The sands include a fines fraction, defined as particles less than forty-four microns, that have a clay component (0–2 microns) and a silica fine sand component (2–44 microns). High bitumen content in the tar sand is usually associated with a low fines fraction. Conversely, a low bitumen content in the tar sand is usually associated with a high fines content.

Typically in the fines fraction there are found two parts silica fine sand component to one part clay component, e.g., one-third is clay. About thirty-five percent of such clay is alumina. Certain low grade ores, conventionally comprised of undifferentiated silica fine sand and clay, have as little as six percent alumina in the fines fraction. Such fines fractions are a problem when used in exothermic reactions that separate out the alumina. Fines fractions, with more than ten percent alumina, are much more easily processed with exothermic reactions. Therefore, it is desirable to have a bitumen separation process that can produce tar sands clays separated from fine sand.

John S. Rendall, the present inventor, describes in U.S. Pat. No. 4,424,112, issued Jan. 3, 1984, a method and apparatus for solvent extraction of bitumen oils from tar sands and their separation into synthetic crude oil and synthetic fuel oil. Tar sands are mixed with hot water and a solvent to form a slurry while excluding substantially all air. The slurry thus contains sand, clay, bitumen oils, solvent and water. This slurry is separated into bitumen extract, which includes bitumen oils, solvent and water, and a solids extract containing sand, clay, solvent and water. The bitumen extract is processed to selectively remove the water and fines. The bitumen extract is then processed to remove the solvent for recycle, and the bitumen as crude oil. Water is separated from the bitumen and solid extracts and is also reused.

A hot water bitumen extraction process is described by John S. Rendall in U.S. Pat. No. 4,875,998, issued Oct. 24, 1989. Crushed tar sands are conditioned in hot water while excluding air. Oversized and inert rocks are removed by screening. A water immiscible hydrocarbon solvent is used to extract the bitumen content to form a bitumen extract phase, a middle water phase, and a lower spent solids phase, each of which are processed for bitumen oils and to recover solvent and water for reuse.

A method of extracting valuable minerals and precious metals from oil sands ore bodies is described by John S. Rendall and Valentine W. Vaughn, Jr., in U.S. Pat. No. 5,124,008, issued Jun. 23, 1992. Both coarse and fine sand fractions are produced after extracting the hydrocarbons, and both fractions contain valuable minerals and precious metals. These fractions are agglomerated with concentrated sulfuric acid and leached. The sulfuric acid mother leach liquor is processed to remove sulfate crystals of aluminum, iron and titanyl, while recycling the raffinate. The aluminum sulfate crystals are converted to cell-grade alumina product.

In United States patent application, Ser. No. 08/356,148, filed Dec. 15, 1994, John S. Rendall and Steven J. Lane describe a system and method for immediately separating oil sands into three layers using a logwasher with paddles that mix the oil sands with hot water and steam. The three layers of: bitumen, clay/sand/water slurry, and rock, effectively and immediately separate and are not re-mixed in further processing as was conventional. A clay fraction from the fines is further produced for mineral processing.

Canadian Patent Application, 2,165,252, of Steven J. Lane, which was laid open Jul. 16, 1997, describes a method of oil sands separation. Such method comprises introducing pre-sized oil sands into one end of a vessel. The oil sands are moved towards a solids outlet in the vessel while breaking up lumps in the oil sands. The solids are compressed at the solids outlet by maintaining a head of solids above a restriction in a hopper. Steam is introduced into the vessel to maintain the temperature of the interior of the vessel such that separation of bitumen from solids takes place, while gas dissolved in the bitumen nucleates and forms entrained gas bubbles within the bitumen that cause flotation of the bitumen. Hot water is introduced into the vessel and removes middlings from the central zone of the vessel to maintain viscosity of the central zone of the vessel such that bitumen and entrained gases rise through the central zone of the vessel to form a surface layer on the material in the vessel. The floating bitumen with entrained gases is then skimmed from the surface layer.

SUMMARY OF THE PRESENT INVENTION

It is therefore an object of the present invention to provide a method for significantly improving the throughput and allowable clay-content in feeds of oil sand conditioning equipment.

It is a further object of the present invention to provide a simplified method for middlings stream clarification, clean sand discharge, and the use of live steam in oil sand conditioning machines.

Briefly, a sand/liquid separator machine embodiment of the present invention provides for the conditioning of oil sands. Clean sand is separated from the ore and discharged for use as backfill. The sand/liquid separator machine includes horizontal shafts with paddles that act on a fluidized bed. The overall height of the machine is increased over prior art devices so the water volume is expanded. For a given residence time, more sand can be separated out than is otherwise possible. The water-to-sand ratio is an independent variable, water is recycled independent of the sand. The rate of water recycle depends only on the heat input needed and the clay content of the feed. The rate of water input is limited by the rise velocity needed to separate sand larger than forty-four micron from the water/liquid phase. This, in turn, determines the maximum oil sand feed rate based on the total clay in the feed at up to six percent, by weight, of clay in the middlings in the machine. This optimizes the performance of the process to cope with all the variables of heat input, ratio of oil sand feed to water, and clay content of the feed.

An advantage of the present invention is that a system is provided that produces substantially cleaner rocks and sand that are free of bitumen, and thus yields more bitumen oils from a given amount of tar sand.

Another advantage of the present invention is that a system is provided in which sand is not pushed out with brute force. It reduces the horsepower input requirements by using a fluidized bed with much easier-to-rotate-paddles.

A further advantage of the present invention is a clarifier is used as an oil/water separator with increased residence time for effective separation, and is set apart from the sand/water separation in the conditioning machine.

A still further advantage of the present invention is gravity can be used, instead of pumps, thus avoiding emulsification of oil/water/clay in the middlings.

Another advantage of the present invention is the use of live steam is reduced or eliminated. Such steam can cause turbulence which mixes the oil/water/clay in the middlings. Instead, an external indirect heat exchanger adds the heat necessary to recycled-and-clarified middlings. This is not only a significant cost savings in boiler feed water treatment but also avoids surplus water build-up that would otherwise need external disposal.

These and other objects and advantages of the present invention will no doubt become obvious to those of ordinary skill in the art after having read the following detailed description of the preferred embodiment that is illustrated in the various drawing figures.

IN THE DRAWINGS

DETAILED DESCRIPTION OF THE PREFERRED EMBODIMENTS

Figure 1:
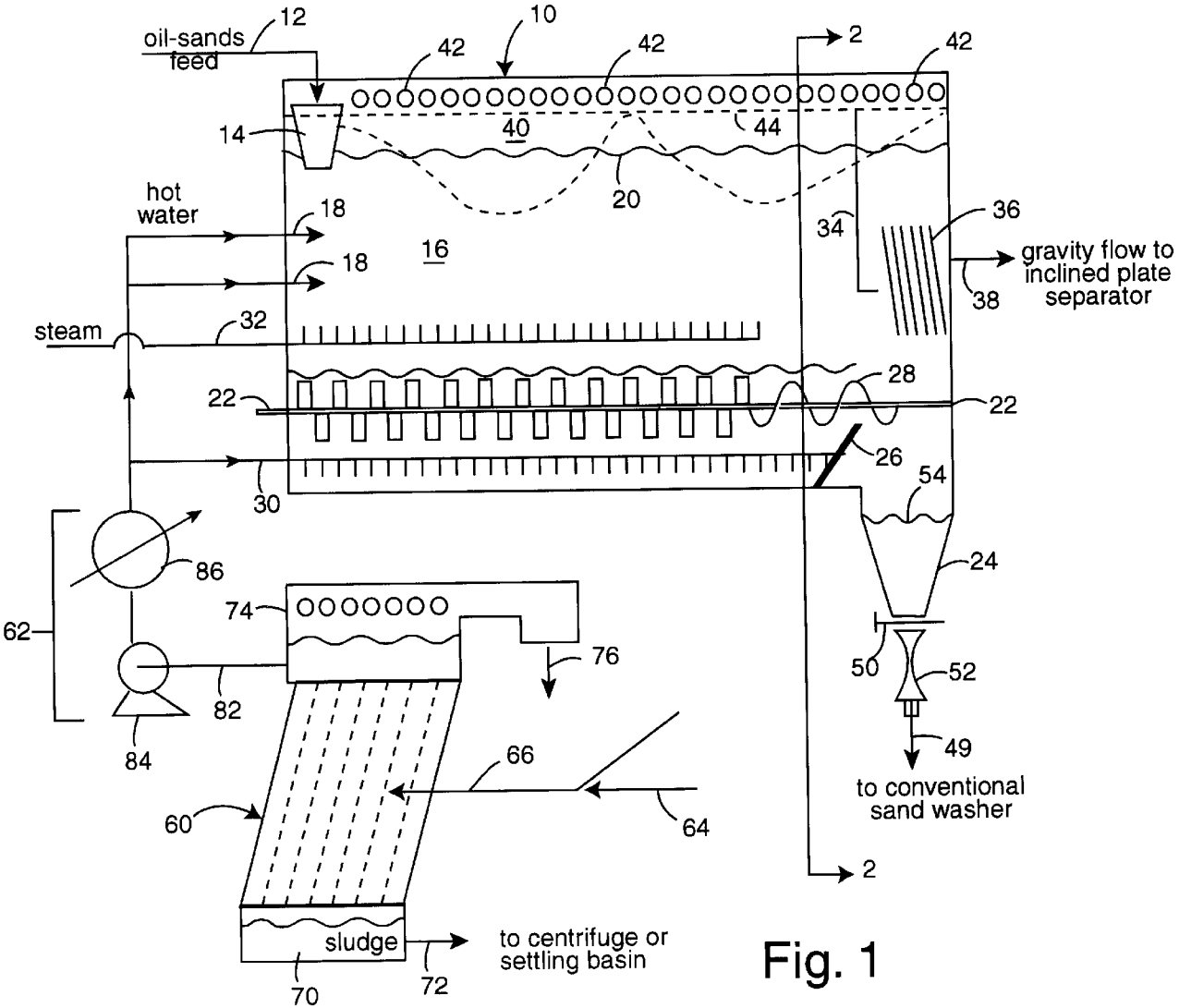
FIG. 1 is a diagram of an improved logwasher system for oil sands and separation of clean sand for backfill in an embodiment of the present invention.
Figure 2:
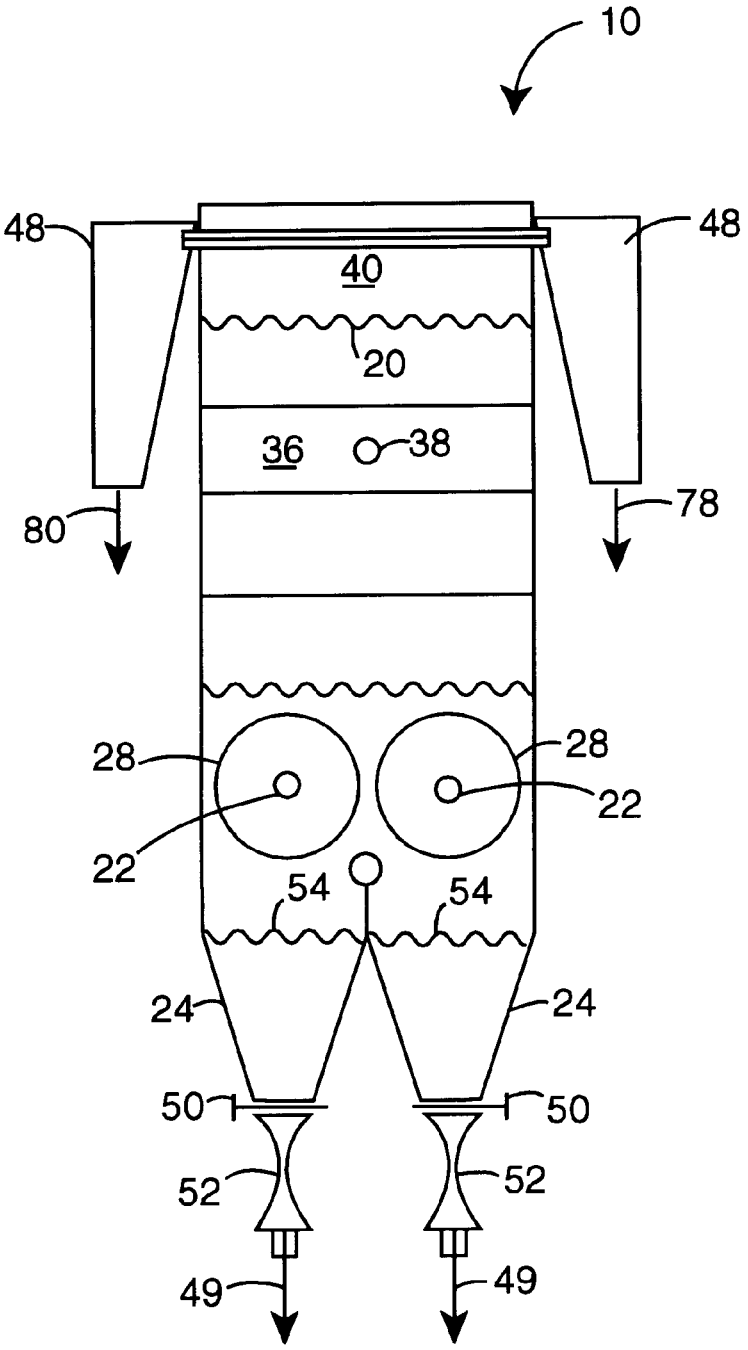
FIG. 2 is a cross-sectional diagram of the machine of FIG. 1 taken along the line 2—2.

FIGS. 1 and 2 illustrate an oil sand conditioning and sand separation logwasher system embodiment of the present invention, and is referred to by the general reference numeral 10. An oil sand feed 12 is fed in through a chute 14 into a middlings water 16. A set of hot water nozzles 18 urge a volume of oil sands through toward the opposite end. This naturally causes any oil to separate and rise into an oil layer 20. Any sand that also separates drops into a set of paddles 22 which agitate and convey a fluidized sand into a discharge pocket 24. Rocks, e.g., with diameters of less than five inches, are moved up a baffle 26 by a set of Archimedes screws 28. The sand is washed free of the middlings water 16 by a clean-hot-water injector 30.

The middlings water 16 is preferably maintained at 75° C. to 95° C. by a flow from the hot water nozzles 18, and this is supplemented if necessary with a flow from a steam injector 32. A baffle 34 provides a quiescent zone in the middlings water 16. The baffle 34 and a set of inclined plates 36 precipitate out a silt and allows a clay-laden water-oil middlings mixture 38 to exit. An oil layer 40 under a set of rotary baffles 42 exits over a weir 44 into a pair of saddle chutes 46 and 48 (FIG. 2 only). The rotary pipes 42 also are able to remove oil as conventional skimmers.

In operation, a flow of separated oil is discharged over weir 44, the middlings discharge 38 is controlled by the height of the middlings/oil interface 20, and a clean sand 49 is periodically dumped from discharge pocket 24 with a set of slide valves 50 and a set of pinch valves 52. The object of operation of the valves 50 and 52 is to keep a sand middlings interface 54 steady. The middlings discharge 38 is preferably less than six percent clay, water, and oil, by weight.

FIG. 1 further illustrates an inclined middlings separator system 60 connected to a clean-recycle-water external heating system 62.

The middlings discharge 38 is controlled by keeping an oil/middlings interface steady, but in the main discharges a quantity of water is directly injected into the system via nozzles 18. This recycle water rate has a maximum limitation dependent on the cross sectional area of the machine 10 which determines the maximum upflow velocity through which sand and silt particles larger than forty-four microns will fall and be discharged. This is a function among other flow patterns of Stokes Law.

The maximum heat that can be input via nozzles 18 depends on the back pressure present. For example, with a back pressure of fifteen psig, about 40° F. of heat in water is available. About one ton of oil sands can be heated by one ton of hot water, e.g., 90,000 BTUs, and can be used to maintain a temperature of about 185° F. (85° C.) in logwasher system 10. However, supplemented steam is available at steam injector 32. The limiting factor could also be the amount of clay in the feed (oil sands). For example, if the feed contains twelve percent (less than forty-four micron particles) then two tons of water are needed per ton of oil sands. Therefore the minimum upflow velocity in the machine determines the maximum water rate. This rate then determines the oil sand feed rate dependent on its clay/silt content of less than forty-four microns.

The system 60 clarifies the middlings stream and is fed by gravity to avoid emulsifying the clay, water, and oil. A flocculant and emulsifier flow 64 added to a flow 66 can assist in the water clarification such that the clarification can be completed in two to thirty minutes. The amounts and kinds of flocculants needed depends on the particular manufacturer's recommendations. For example, a dry aniomic flocculant, Cytec Magnifloc 866A, provided excellent clarification in two minutes at a dose of seven to ten parts per million. A sludge 70, mainly comprising clay and water, is collected at the bottom of the separator and is pumped out in a flow 72 to a hydrocyclone to remove silt greater than twenty microns, or to a centrifuge for cake discharge, or to a setting-storage basin or pond for reuse.

The water and oil is separated conventionally at the top of the inclined plate separator in a chamber 74 with an oil exit flow 76. An oil flow 78 and 80 (FIG. 2 only) is combined with the oil exit flow 76 (FIG. 1 only) for further treating to remove water and solids from the oil.

A clarified water discharge 82 is connected to a pump 84 which forces the water through an indirectly heated tube or plate heat exchanger 86. The preferred method of heating is to use a high pressure steam. The condensate water is returned to the boiler for its feed water to minimize the need for make-up water and to reduce costs. The hot water at elevated temperature is then fed into logwasher system 10 to condition the oil sands and separate the sand.

Figure 3:
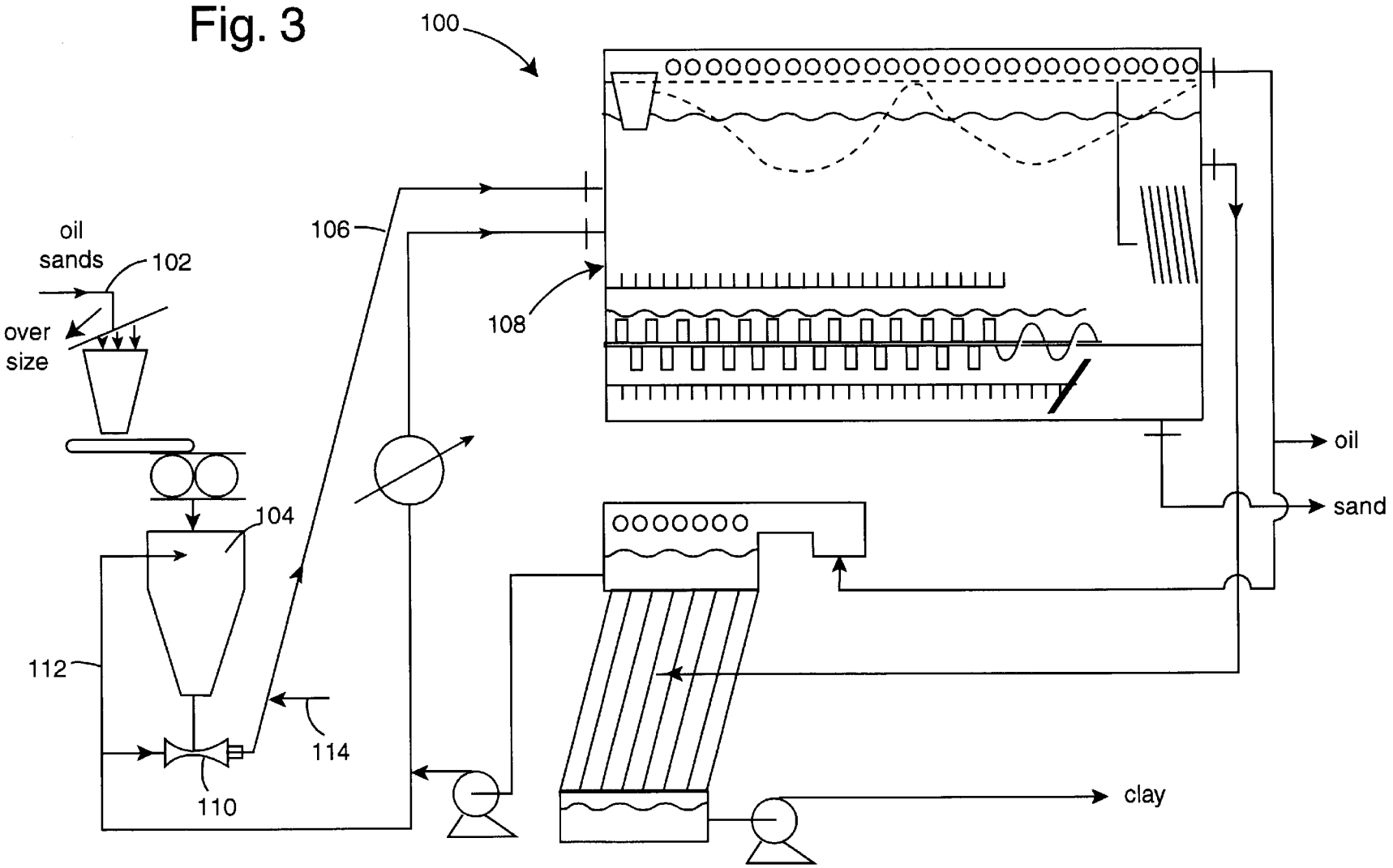
FIG. 3 is a diagram illustrating an oil sand feed for the logwasher of FIG. 1

FIG. 3 illustrates an alternative embodiment of the present invention, a slurry feed system 100. An oil sand feed 102 crushed from a mine in lumps preferably under four inches in diameter are fed into a cyclo-feeder 104 to create a slurry 106 that is fed to a logwasher system logwasher system 108. Logwasher system 10 could be used as the logwasher system 108. A jet or slurry pump 110 and the cyclo-feeder 104 are both connected to a hot water feed 112. A pressurized carbon dioxide flow 114 can be added to the slurry 106 if the line is maintained under pressure before being discharged into the logwasher system 108. Research by others has shown that any bitumen in slurry flow 106 can be altered to have a reduced viscosity around 350 centistokes and increased API (gravity) from nine (1.01 sg) to about twelve (0.985 sg). However, the main mechanism of flotation is believed to be entrained air/gas, as is described in the laid-open Canadian Patent Application 2,165,252, of Rendall and Lane.

The remainder of that shown in FIG. 3 is similar in construction and operation to that illustrated in FIGS. 1 and 2.

Prior art systems do not independently recycle the hot water middlings in a clarifier circuit including an inclined plate separator such as separator 60. This is very important, the oil sand feed can be independent of ore/water ratio. The clay content of the feed is not a limiting factor. In conventional systems, the water/oil sands ratio can limit the percentage of clays in the water to less than six percent to allow oil/bitumen separation. The prior art practice of adding live steam can inhibit the separation process. The steam causes emissions that result in a loss of bitumen that occurs with the clay removal.

More and sufficient heat may be added to the recycle water as it is pumped back via system 62, e.g., to maintain the temperature between 75° C. and 95° C. In the case where carbon dioxide is added, temperatures as low as 60° C. can be used. Live steam can be minimized to act only as a heat makeup when necessary. The clean sand from system 10 can be prepared for back fill with a dewaterer such as a sand screw placed either at the plant or with a recycle water system at a mine.

A process embodiment of the present invention for oil sand conditioning and sand separation comprises mixing oil sands and hot water in a logwasher vessel to form a mixture. Then agitating the mixture to promote removal of sand with a set of rotating paddles. Water is injected alongside the rotating paddles to wash the sand before it becomes settled sand. Steam is injected in a middlings zone above the settled sand. Hot water is injected in the middlings zone to move an oil sand across an area of the logwasher vessel, removing a middlings flow from a quiescent zone. Oil is removed over a weir with a set of rotating tubes that assist oil recovery and stabilize the surface. A chute is provided for an oil sand feed at one end away from a middlings removal point and above a hot water injection site.

An oil sand feed rate can be used that allows for a residence time of two to ten minutes. The rate of rise of water introduced is such that over ninety percent of particles greater than forty-four microns in the mixture will settle out. The temperature of introduced oil sand ore is increased up to 85° C. to 95° C. using hot water. The amount of live steam injection is limited to a maximum of twenty percent of the weight of sand solids introduced into the vessel to maintain a water balance. The rate of the clay fed into the machine, up to six percent by weight of the water introduced, is limited.

The process can further include withdrawing and recycling a middlings water comprising water, oil and clay. The middlings water is fed to a clarifier and/or inclined plate separator to continuously remove sludge and produce a clarified water. A flocculant can be added to improve separation and reduce residence time. The clarified water is directly heated and re-injected at a temperature sufficient to maintain an overall temperature of 75° C. to 95° C.

The solids can be filtered from the bitumen by heating and pressurizing a feed bitumen to pass through a filter cartridge disposed within a chamber. A particular pressure is maintained downstream of the filter cartridge that is just above a bubble point pressure at a given temperature that prevents flashing of any light hydrocarbons and/or water that may be entrained in the feed bitumen. A pressure applied to the feed bitumen is increased in response to a flow resistance buildup caused by filter caking to maintain a particular bitumen flow rate. The temperature of the bitumen is adjusted for a particular process viscosity. The filter cartridge has openings sized according to a particular particle size distribution of solid particles within the bitumen.

The sludge from the clarifier can be discharged into a settling pond and the water recycled. Or the clay and silt fraction can be separated with a hydro-cyclone and discharged into a settling pond for storage of the clay. The clay fraction can also be centrifuged for cake discharge.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A process for oil sand conditioning and sand separation, comprising the steps of:

mixing a feed of oil sands through a chute and into a flow of hot water in a logwasher vessel to form a mixture in a middlings water contained therein;

agitating said mixture in said middlings water with a set of rotating paddles which agitate and convey a fluidized sand into a discharge pocket;

injecting a flow of hot water above and alongside said rotating paddles to wash a sand portion of said oil sands before it can settle in a bottom area of said logwasher vessel;

injecting hot water in a sand settling area underneath said rotating saddles to wash said sand portion free of said middlings water;

removing a middlings flow from a quiescent zone at an end of said logwasher vessel opposite to said chute, and in which said quiescent zone is created by a skimming baffle and a set of inclined plates inside said logwasher that precipitate out a silt and allow a clay-laden water-oil middlings mixture to be drawn out;

removing oil in said oil layer from a surface of said middlings water with a weir placed inside said logwasher vessel, and using a set of rotating tubes to promote oil recovery and stabilize said middlings water surface; and periodically dumping any sand that has accumulated in said discharge pocket.

2. The process of claim 1, further comprising the steps of:

using an oil sand feed rate that allows for a residence time of two to ten minutes;

adjusting a rate of rise of water introduced such that over ninety percent of particles greater than forty-four microns in said mixture will settle out;

increasing the temperature of an introduced oil sand ore up to a temperature of 75° C. to 95° C. with hot water;

limiting the amount of live steam injection to a maximum of twenty percent of the weight of sand solids introduced into the vessel to maintain a water balance; and limiting the rate of the clay fed into said logwasher vessel up to six percent by weight of the water introduced.

3. The process of claim 2, further comprising the steps of:

withdrawing and recycling a middlings water comprising water, oil and clay;

feeding said middlings water to a clarifier and/or inclined plate separator to continuously remove sludge and produce a clarified water; and adding flocculant to improve separation and reduce residence time.

4. The process of claim 3, further comprising the steps of:

directly heating said clarified water and re-injecting at a temperature sufficient to maintain an overall temperature of 75° C. to 95° C.

5. The process of claim 3, further comprising filtering solids from bitumen with the steps of:

heating and pressurizing a feed bitumen to pass through a filter cartridge disposed within a chamber;

maintaining a particular pressure downstream of said filter cartridge that is just above a bubble point pressure at a given temperature that prevents flashing of any light hydrocarbons and/or water that may be entrained in said feed bitumen; and increasing a pressure applied to said feed bitumen in response to a flow resistance buildup caused by filter caking to maintain a particular bitumen flow rate;

wherein the temperature of said bitumen is adjusted for a particular process viscosity; and wherein, said filter cartridge has openings sized according to a particular particle size distribution of solid particles within said bitumen.

6. The process of claim 3, further comprising the steps of:

discharging a sludge from a clarifier into a settling pond and recycling water.

7. The process of claim 3, further comprising the steps of:

separating a clay and silt fraction with a hydrocyclone and discharging into a settling pond for recycle of the water and storage of the clay.

8. The process of claim 7, further comprising the step of:

centrifuging said clay fraction for cake discharge.

* * * * *